US005851746A

United States Patent [19]

Rieger et al.

[11] Patent Number: 5,851,746

[45] **Date of Patent: *Dec. 22, 1998**

[54] PHOTOGRAPHIC SILVER HALIDE ELEMENT HAVING POLYETHYLENE NAPHTHALATE SUPPORT AND THIN NON-IMAGING BOTTOM LAYERS

[75] Inventors: John Brian Rieger, Rochester; Drake Matthew Michno, Webster, both of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 978,675

[22] Filed: Nov. 26, 1997

Related U.S. Application Data

[63] Continuation of Ser. No. 652,875, May 23, 1996, abandoned, which is a continuation-in-part of Ser. No. 593,224, Jan. 29, 1996, abandoned.

[51] Int. Cl.[6] ..... G03C 1/815

[52] U.S. Cl. ..... 430/510; 430/523; 430/527; 430/530; 430/531; 430/533; 430/546; 430/551; 430/642

[58] Field of Search ..... 430/642, 505, 430/510, 523, 527, 530, 531, 533, 546, 551

[56] References Cited

U.S. PATENT DOCUMENTS

| | | | |
|---|---|---|---|
| 4,214,047 | 7/1980 | Chen | 430/448 |
| 5,230,994 | 7/1993 | Yamda et al. | 430/539 |
| 5,292,628 | 3/1994 | Nittel et al. | 430/527 |
| 5,360,708 | 11/1994 | Takada et al. | 430/533 |
| 5,464,733 | 11/1995 | Friday | 430/551 |
| 5,556,738 | 9/1996 | Takamuchi et al. | 430/531 |

OTHER PUBLICATIONS

Hatsumei Kyoukai Gihou No. 94–6023, published Mar. 15, 1994 by Hatsumei Kyoukai (Japan).

*Primary Examiner*—Geraldine Letscher
*Attorney, Agent, or Firm*—Arthur E. Kluegel

[57] ABSTRACT

A photographic element comprises an ultraviolet ray absorbing polyester support bearing a light-sensitive silver halide photographic emulsion layer, the support having adjacent thereto one or more contiguous non imaging layers between the support and the closest silver halide photographic emulsion layer said one or more contiguous layers containing a combined gelatin laydown of 2.3 g/m$^2$ or less.

17 Claims, No Drawings

PHOTOGRAPHIC SILVER HALIDE ELEMENT HAVING POLYETHYLENE NAPHTHALATE SUPPORT AND THIN NON-IMAGING BOTTOM LAYERS

CROSS-REFERENCE TO RELATED APPLICATION

This is a Continuation of application Ser. No. 08/625,875, filed May 23, 1996. Abandoned, which is a Continuation-In-Part of application Ser. No. 08/593,224, filed Jan. 29, 1996, entitled "Photographic Silver Halide Element Having Polyethylene Naphthalate Support And Thin Non-Imaging Bottom Layers" now abandoned.

FIELD OF THE INVENTION

This invention relates to silver halide photographic materials, and more specifically to multilayer photographic materials comprising polyethylene naphthalate support having coated thereon one or more non-imaging layers one of which is adjacent to the support and all of which are contiguous with each other, which comprise a total gelatin coverage of 2.3 g/m$^2$ or less.

BACKGROUND OF THE INVENTION

It is well known to coat silver halide photographic materials on cellulose acetate supports. In certain instances, it has been found advantageous to coat these materials on polyester supports when increased dimensional stability or mechanical strength of the photographic element is desired, as described in U.S. Pat. No. 3,649,336. In particular, it has been found that specific polyester supports, like (but not limited to) polyethylene naphthalate ("PEN") supports, have excellent mechanical strength and curl relaxation characteristics compared to other supports.

It is also well known that there are advantages in employing small negative sizes in amateur photography, as described in Research Disclosure 36230, June 1994, pp316–329. It is envisioned that amateur photographers will want to have the option of a large number of exposures in a roll (or cassette) of film, without the cassette becoming unduly large and bulky. While 36 exposures is now commonly available, there is a need for 40 or more exposures in a single roll. In order to accommodate this large number of exposures, the total film thickness must be such that the total length of film will fit inside of the film cassette without jamming or binding. This is especially important during periods of high humidity, where the gelatin can swell and cause the film to stick or jam. Thinner support may be used to reduce total film thickness, but problems arise when the support becomes too thin, such as lack of dimensional stiffness and a high tendency to curl.

It is also desired that the film is protected from fogging due to an electrostatic discharge. In the past this was accomplished through the incorporation of ultraviolet light absorbing (UV) dyes dispersed in coupler solvent in layers above and below the light sensitive imaging layers. In this way, the film is protected against spark generated UV radiation coming in from the front or the back. The dye and the coupler solvent in which the dye is dispersed contribute to the overall thickness of the film. Gelatin may be reduced to decrease thickness, but when the gelatin laydown becomes too low, the coupler solvent coated in the layers below the non-imaging layers may weaken the adhesive bond between those layers and the support.

It has been recognized that a feature of PEN base is it's ability to absorb ultraviolet light at 380 nm, as discussed in Hatsumei Kyoukai Koukai Gihou No. 94-6023 Section 12, published by the Japanese Patent Office.

It is also well known to use elemental silver as an antihalation component in a photographic element.

It is also desired that the adhesion between the photographic layers and the support is sufficient. In the manufacturing process, the photographic material is subjected to slitting or cutting operations and in many cases perforated holes are punched into the material for film advancement in cameras and processors. Poor adhesion can result in a delamination of the photographic layers from the support at the cut edges of the photographic material which can generate many small fragments of chipped-off emulsion layers which then cause spot defects in the imaging layers of the photographic material. These problems are especially evident when utilizing PEN as the support material. Methods are known for improving adhesion through the judicious choice of coupler solvent type and of the relative gelatin to coupler solvent ratio. But, in order to maintain an acceptable level of gelatin for a given level of coupler solvent, a thicker layer must be used. The preferred coupler solvents known for this purpose have also been found to improve adhesion when coated in layers above the layer adjacent to the support, such as in interlayers and in light sensitive layers.

It is also desired that a low level of minimum density is featured in the film. When the minimum density is too high, especially in the red light sensitive layer, a decrease in printer productivity may be incurred. This is due to longer printing times necessary to transmit light through the negative. There is also a practical limit to the minimum density where failures in reading edge printing will result. Physical development of the imaging layer adjacent to the layer containing elemental silver used for antihalation will result in higher dmin. This is especially evident in films which utilize a bleach accelerator releasing coupler, or BARC, in the imaging layer adjacent to the layer containing elemental silver. In the past, this problem has been solved by decreasing the elemental silver concentration at the interface by increasing the gelatin level of the layer containing the elemental silver. This approach is not very effective and results in increased thickness. Another method is to coat another layer between the bottom imaging layer and the layer which contains the elemental silver. This approach can be quite effective at lowering minimum density, but also results in increased total film thickness.

Thus, the problem to be solved is to provide a photographic element having polyethylene naphthalate or similar support which has adequate adhesion, and which also has adequate protection against undesired fogging through the base from sparks generated from static electricity, and which permits low gains in minimum density upon processing, and which has a reduced layer and film thickness.

SUMMARY OF THE INVENTION

The invention provides a photographic element comprising an ultraviolet ray absorbing polyester support bearing a light-sensitive silver halide photographic emulsion layer, the support having adjacent thereto one or more contiguous non imaging layers between the support and the closest silver halide photographic emulsion layer, said one or more contiguous layers containing a combined gelatin laydown of 2.3 g/m$^2$ or less.

DETAILED DESCRIPTION OF THE INVENTION

The invention encompasses a photographic element comprising a polyethylene naphthalate support bearing one or more light-sensitive silver halide photographic emulsion layers, the support having adjacent thereto one or more contiguous non-imaging layers, which comprise a total gelatin coverage of 2.5 g/m$^2$ or less, or more preferably 2.3 g/m$^2$ or less, or most preferably 1.7 g/m$^2$ or less, which contain an antihalation agent, such as elemental silver, and which is substantially free of any ultraviolet absorbing materials. Substantially free indicates a formulation which contains substantially less UV absorber than customary heretofore, and desirably not more than 0.01 g/m$^2$ of ultraviolet absorbing materials.

The invention further includes a photographic element comprising a polyethylene naphthalate support bearing one or more light-sensitive silver halide photographic emulsion layers, the support having adjacent thereto one or more contiguous non-imaging layers, in which at least one of such layers contains a scavenger for oxidized developer. Such scavengers are described in the Research Disclosure and other publications hereafter, and suitable examples include compounds such as:

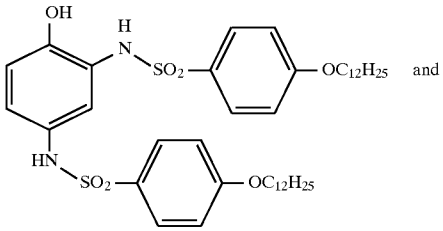

and

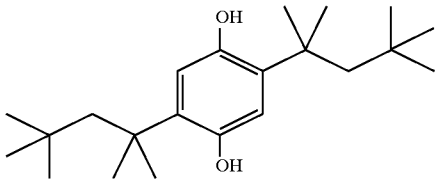

In one suitable embodiment, it is useful to use a hydrophobic solvent to carry the scavenger. Such materials have a high log P, which is the partition coefficient. Hi values represent a more hydrophobic solvent. Values in excess of 7.7 are preferred.

The Log P of a liquid is the logarithm of the liquid's octanol/water partition coefficient. It may be determined experimentally in accordance with standardized procedure or may be calculated in accordance with Medchem version 3.54 software available from the Medicinal Chemistry Project, Pomona College, Claremont, Calif. or from C. Hansch and A. J. Leo, *Substituent Constants for Correlation Analysis in Chemistry and Biology*, Wiley, N.Y., 1979.

Specific examples of suitable liquids include, but are not limited to, tri-(2-ethylhexyl)phosphate, tri-octylphosphineoxide, 1,4-cyclohexylenedimethylene bis-(2-ethylhexanoate), p-dodecylphenol, hexadecane, isopropylpalmitate, di-n-octyl phthalate, bis-(2-ethylhexyl) phthalate, dinonyl phthalate, didecylphthalate, didodecylphthalate, bis-(2-ethylhexyl) azelate, trioctylamine, dodecylbenzene, dioctylsebacate, diisooctylsebacate, dioctyl adipate, bis-(2-ethylhexyl) adipate and tri-(2-ethylhexyl) citrate, di-(2,4-di-t-butylphenyl)isophthalate, di-(isodecyl)4,5-epoxytetrahydrophthalate, di-amyl naphthalene, and tri-amylnaphthalene.

Of these compounds, tri-(2-ethylhexyl)phosphate, 1,4-cyclohexylenedimethylene bis-(2-ethylhexanoate), bis-(2-ethylhexyl)phthalate, didecylphthalate, and didodecylphthalate are particularly suitable.

The invention provides a photographic element having polyethylene naphthalate or similar support which has adequate adhesion, and which also has adequate protection against fogging through the base from sparks generated from static electricity, and which is low in minimum density, and which has a minimum total film thickness.

Supports which can be used in this invention include any supports of hydrophobic, high molecular weight polyesters which contain ultraviolet absorbing structural elements, such as napthol. These ultraviolet absorbing elements can be inherently part of the polyester (such as naphthalate, anthracate, or other fused polycyclic aromatic dicarboxylate) or added as a co-polymer, or grafted onto the core polyester used to prepare the support. The only requirements are:

(1) the support has structural integrity to enable desired cure, strength, and performance features;, and (2) the product of support thickness times the extinction coefficient for wavelengths in the ultraviolet region is sufficient to prevent undesired exposure of the light sensitive elements to ultraviolet irradiation.

Preferred are supports containing at least one polymer derived from a monomer selected from the group consisting of 2,5-, 2-6-, and 2,7-naphthalene dicarboxylic acids.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic element features and processing steps are described in *Research Disclosure*, Item 37038, February 1995 and related to PEN supports in *Hatsumei Kyoukai Koukai Gihou No.* 94-6023.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

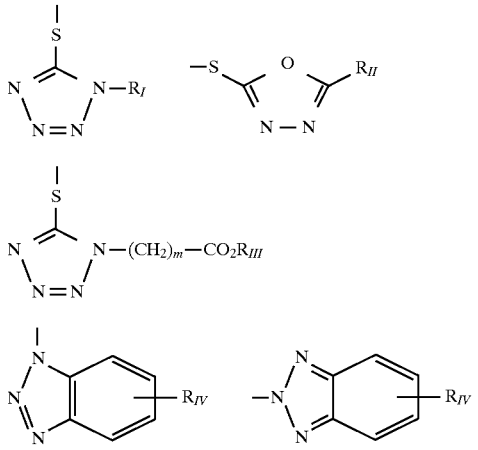

wherein $R_I$ is selected from the group consisting of straight and branched alkyls of from 1 to about 8 carbon atoms, benzyl, phenyl, and alkoxy groups and such groups containing none, one or more than one such substituent; $R_{II}$, is selected from $R_I$ and—$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and—$NHCOOR_V$ wherein $R_V$ is selected from substituted and unsubstituted alkyl and aryl groups.

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

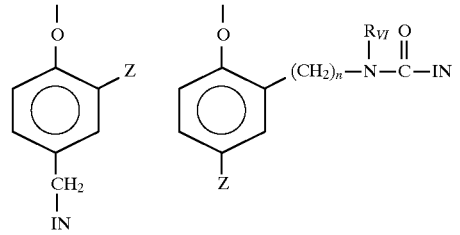

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

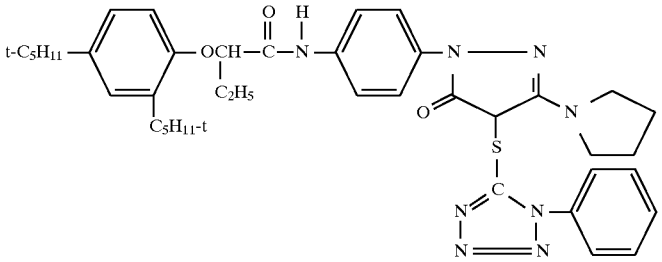

D2

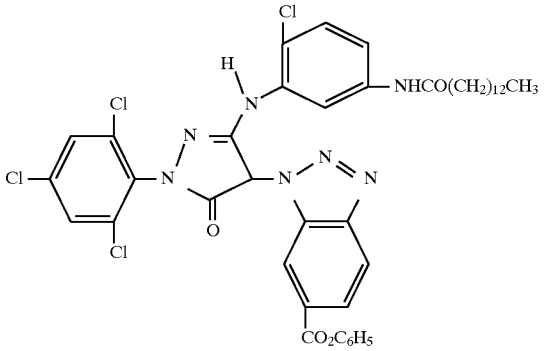

D3

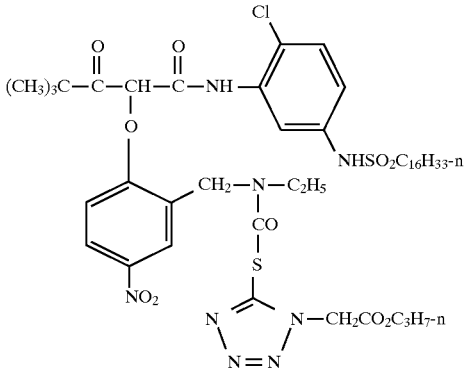

-continued
D4
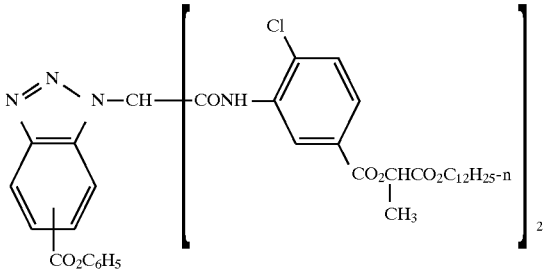
D5
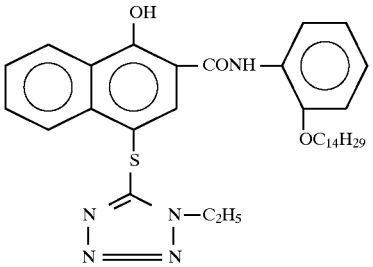
D6
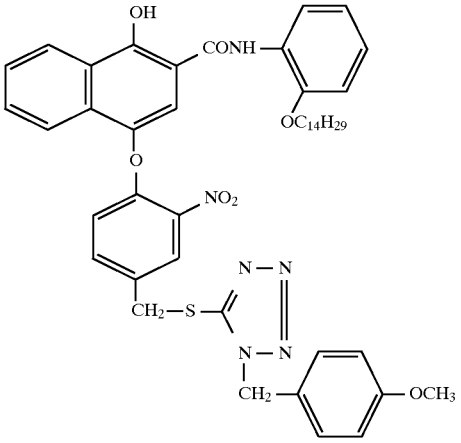
D7
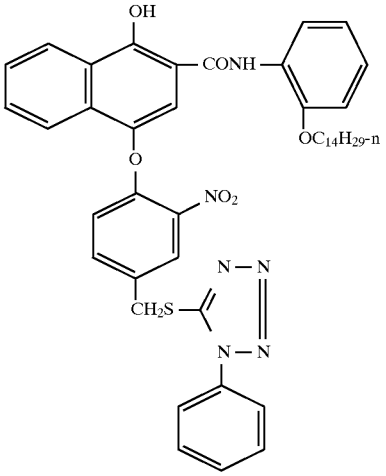

-continued
D8
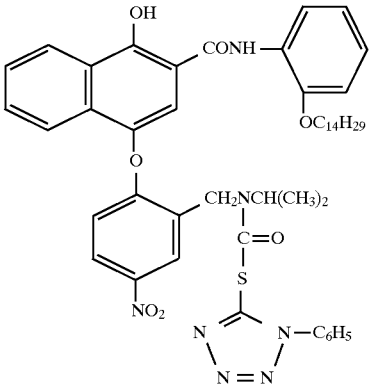
D9
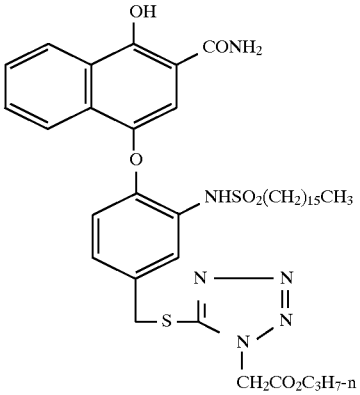
D10
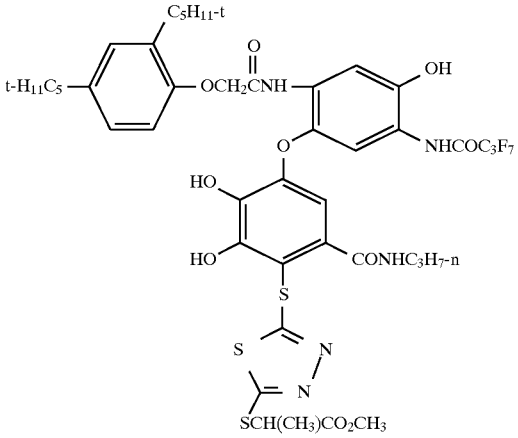
D-11
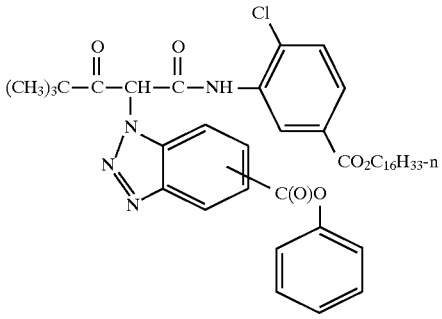

-continued

D-12

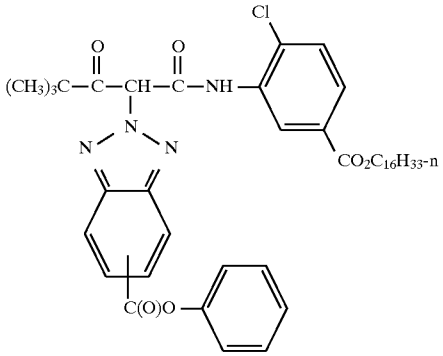

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, Jan. 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198. Where applicable, the element may be processed in accordance with color print processes such as the RA-4 process of Eastman Kodak Company as described in the British Journal of Photography Annual of 1988, Pp 198–199. Such negative working emulsions are typically sold with instructions to process using a color negative method such as the mentioned C-41 or RA-4 process. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamido-ethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patents and other publications cited in this specification are incorporated herein by reference.

Example 1

To a corona-discharge-treated polyethylene-2,6-naphthalene support, which was coated with a continuous subbing layer consisting of a terpolymer of n-butyl acryate, 2-aminoethyl methacrylate hydrochloride, and 2-hydroxyethyl methacrylate (50:05:45) at 0.317 g/m$^2$; deionized gelatin at 0.056 g/m$^2$; matte beads at 0.001 g/m$^2$ ; and surfactant 10G® (Dixie) at 0.012 g/m $^2$; the following layers were applied in the indicated sequence to produce Coating 1-1. The quantities quoted each relate to g/m$^2$ . Emulsion sizes as determined by the disc centrifuge method are reported in Diameter×Thickness in microns. The emulsions in the cyan layers are sensitized with dye set 1. The emulsions in the magenta layers are sensitized with dye set 2. The emulsions in the yellow layers are sensitized with sensitizing dye YD-A.

Formulas for the compounds are given at the conclusion of the examples.

| | |
|---|---|
| **Layer 1** | |
| AntiHalation Undercoat | |
| Black colloidal silver | 0.151 |
| Gelatin | 2.44 |
| Hexasodium salt of metaphosphoric acid | 0.011 |
| Disodium salt of 3,5,-disulfocatecol | 0.270 |
| Dye 1 | 0.057 |
| Dye 2 | 0.028 |
| Oxidized developer scavenger O-1 | 0.16 |
| Dye-6 | 0.12 |
| Dye 3 | 0.0075 |
| 4-4-phenyl disulfide diacetanilide | 0.0012 |
| UV-1 | 0.075 |
| UV-2 | 0.075 |
| 4-carboxymethyl-4-thiazolone-2-thione | 0.0009 |
| Coupler Solvent CS-1 | 0.515 |
| Coupler Solvent CS-2 | 0.15 |
| **Layer 2** | |
| Slow cyan layer | |
| Tabular emulsion, 1.1 × .09, 4.1 mole % I | 0.414 |
| Tabular emulsion, 0.5 × .08, 1.3 mole % I | 0.506 |
| Gelatin | 1.69 |
| Cyan dye forming coupler C-1 | 0.513 |
| Bleach accelerator releasing coupler B-1 | 0.037 |
| Masking Coupler MC-1 | 0.026 |
| **Layer 3** | |
| Mid cyan layer | |
| Tabular emulsion, 1.3 × .12, 4.1 mole % I | 0.699 |
| Gelatin | 1.79 |
| Cyan dye forming coupler C-1 | 0.180 |
| Development inhibitor releasing coupler DIR-1 | 0.01 |

-continued

| | |
|---|---|
| Masking Coupler MC-1 | 0.022 |
| **Layer 4** | |
| Fast cyan layer | |
| Tabular emulsion, 2.9 × .13, 4.1 mole % I | 1.076 |
| Gelatin | 1.42 |
| Cyan dye forming coupler C-1 | 0.104 |
| Development inhibitor releasing coupler DIR-1 | 0.019 |
| Development inhibitor releasing coupler DIR-2 | 0.048 |
| Masking Coupler MC-1 | 0.032 |
| **Layer 5** | |
| Interlayer | |
| Gelatin | 1.29 |
| **Layer 6** | |
| Slow magenta layer | |
| Tabular emulsion, 1.0 × .09; 4.1 mole % I | 0.280 |
| Tabular emulsion, 0.5 × .08, 1.3 mole % I | 0.542 |
| Gelatin | 1.58 |
| Magenta dye forming coupler M-1 | 0.255 |
| Masking Coupler MC-2 | 0.059 |
| **Layer 7** | |
| Mid magenta layer | |
| Tabular emulsion, 1.3 × .12, 4.1 mole % I | 0.968 |
| Gelatin | 1.26 |
| Development inhibitor releasing coupler DIR-3 | 0.024 |
| Magenta dye forming coupler M-1 | 0.054 |
| Masking Coupler MC-2 | 0.064 |
| **Layer 8** | |
| Fast magenta layer | |
| Tabular emulsion, 2.3 × .12, 4.1 mole % I | 0.968 |
| Gelatin | 1.12 |
| Development inhibitor releasing coupler DIR-4 | 0.011 |
| Development inhibitor releasing coupler DIR-5 | 0.011 |
| Magenta dye forming coupler M-1 | 0.043 |
| Masking Coupler MC-2 | 0.054 |
| **Layer 9** | |
| Yellow filter layer | |
| Yellow filter dye AD-1 | 0.108 |
| Gelatin | 1.29 |
| **Layer 10** | |
| Slow yellow layer | |
| Tabular emulsion, 0.8 × .09, 4.5 mole % I | 0.193 |
| Tabular emulsion, 1.0 × .25, 6.0 mole % I | 0.320 |
| Tabular emulsion, 0.5 × .08, 1.3 mole % I | 0.230 |
| Gelatin | 2.51 |
| Yellow dye forming coupler Y-1 | 0.750 |
| Yellow dye forming coupler Y-2 | 0.289 |
| Development inhibitor releasing coupler DIR-6 | 0.064 |
| Cyan dye forming coupler C-1 | 0.027 |
| Bleach accelerator releasing coupler B-1 | 0.003 |
| **Layer 11** | |
| Fast yellow layer | |
| Tabular emulsion, 3.3 × .14, 4.1 mole % I | 0.227 |
| 3-D emulsion, 1.1 × .40, 9.0 mole % I | 0.656 |
| Gelatin | 1.57 |
| Yellow dye forming coupler Y-1 | 0.206 |
| Yellow dye forming coupler Y-2 | 0.080 |
| Development inhibitor releasing coupler DIR-6 | 0.047 |
| Cyan dye forming coupler C-1 | 0.029 |
| Bleach accelerator releasing coupler B-1 | 0.005 |
| **Layer 12** | |
| UV filter layer | |
| Silver bromide Lippmann emulsion | 0.215 |

-continued

| | |
|---|---|
| UV-1 | 0.108 |
| UV-2 | 0.108 |
| Gelatin | 0.699 |
| Layer 13 | |
| Protective overcoat layer | |
| Colloidal silica | 0.108 |
| Gelatin | 0.882 |

Hardener(bis(vinylsulfonyl)methane at 1.75% of total gelatin weight). Unless otherwise noted, antifoggants (including 4-hydroxy-6-methyl-1,3,3a,7-tetraazaindene), surfactants, coating aids, emulsion addenda, sequestrants, lubricants, matte, coupler solvents, and tinting dyes were added to the appropriate layers as is common in the art. Magnetic recording layers were coated on the backside of the support.

Coating 1-2 was prepared like coating 1-1 except that layer 1 had a gelatin coverage of 1.61 g/m$^2$.

Coating 1-3 was prepared like coating 1-1 except that layer 1 had a gelatin coverage of 1.61 g/m$^2$, UV-1 was omitted, UV-2 was omitted, and CS-2 was omitted.

Coating 1-4 was prepared like coating 1-1 except that layer 1 had a gelatin coverage of 1.61 g/m$^2$, UV-1 was omitted, UV-2 was omitted, CS-2 was omitted, O-1 was omitted, and CS-1 was reduced to 0.35.

Film Cutting Test

A coated photographic film to be tested was placed between two parallel blades, one stationary and another traveling at a fixed speed, with a constant narrow clearance set between the blades. The film is cut when the moving blade passes the stationary blade. The cutting performance was evaluated by microscopic examination of the cut edges.

Minimum Density

All films were processed in the known Kodak C-41 color process as described in The British Journal of Photography Annual of 1988, pages 191–198. Minimum density, otherwise known as Dmin, was determined by Status M densitometry of C-41 processed film samples which received no light exposure.

The results are shown in Table I.

TABLE I

| Coating # | Type | Layer 1 gel/CS | Appearance of Cut Edge | Red Minimum Density | Gelatin Coverage g/m$^2$ |
|---|---|---|---|---|---|
| 1-1 | Comp | 3.7 | ok | .32 | 2.44 |
| 1-2 | Comp | 2.4 | Delaminated | .33 | 1.61 |
| 1-3 | Inv | 3.1 | ok | .33 | 1.61 |
| 1-4 | Inv | 4.6 | ok | .37 | 1.61 |

Gel/CS refers to (gelatin level)/(total coupler solvent level) and is a good indicator of the strength of a layer.

Coating 1-1 features an undesirably thick antihalation layer. Coating 1-2 features a thinner antihalation layer but the layer integrity suffers as there is not enough gelatin to hold together the coupler solvent load. It has been found that gel/CS ratios greater or equal to 2.9 are necessary to insure adequate layer integrity. With a reduced minimum red density, coating 1-3 provides the best combination of features for finishability, minimum density, and thickness. Coating 1-4 would be useful for a film without stringent minimum density requirements.

Example 2

To a corona-discharge-treated polyethylene-2,6-naphthalene support, which was coated with a continuous subbing layer consisting of a terpolymer of n-butyl acryate, 2-aminoethyl methacrylate hydrochloride, and 2-hydroxyethyl methacrylate (50:05:45) at 0.317 g/m$^2$; deionized gelatin at 0.056 g/m$^2$; matte beads at 0.001 g/m$^2$; and surfactant 10G® (Dixie) at 0.012 g/m$^2$; the following layers were applied in the indicated sequence to produce Coating 2-1. The quantities quoted each relate to g/m$^2$. Emulsion sizes as determined by the 5 disc centrifuge method are reported in Diameter×Thickness in microns. The emulsions in the cyan layers are sensitized with dye set 1. The emulsions in the magenta layers are sensitized with dye set 2. The emulsions in the yellow layers are sensitized with 10 sensitizing dye YD-A.

| | |
|---|---|
| Layer 1 | |
| AntiHalation Undercoat | |
| Black colloidal silver | 0.151 |
| Gelatin | 1.61 |
| Hexasodium salt of metaphosphoric acid | 0.007 |
| Disodium salt of 3,5,-disulfocatecol | 0.18 |
| Dye 1 | 0.079 |
| Dye 2 | 0.019 |
| Oxidized developer scavenger O-2 () | 0.108 |
| Dye-6 | 0.077 |
| Dye 3 | 0.022 |
| UV-1 | 0.032 |
| UV-2 | 0.075 |
| Coupler Solvent CS-1 | 0.38 |
| Coupler Solvent CS-2 | 0.108 |
| Coupler Solvent CS-3 | 0.17 |
| Layer 2 | |
| Slow cyan layer | |
| Tabular emulsion, 0.8 × .12, 4.1 mole % I | 0.33 |
| Tabular emulsion, 0.5 × .08, 1.3 mole % I | 0.29 |
| Gelatin | 1.36 |
| Cyan dye forming coupler C-1 | 0.43 |
| Bleach accelerator releasing coupler B-1 | 0.054 |
| Layer 3 | |
| Mid cyan layer | |
| Tabular emulsion, 1.1 × .12, 4.1 mole % I | 0.97 |
| Gelatin | 1.35 |
| Cyan dye forming coupler C-1 | 0.34 |
| Development inhibitor releasing coupler DIR-1 | 0.043 |
| Bleach accelerator releasing coupler B-1 | 0.032 |
| Masking Coupler MC-1 | 0.011 |
| Layer 4 | |
| Fast cyan layer | |
| Tabular emulsion, 1.4 × .12, 4.1 mole % I | 0.86 |
| Gelatin | 0.97 |
| Cyan dye forming coupler C-1 | 0.12 |
| Development inhibitor releasing coupler DIR-1 | 0.043 |
| Masking Coupler MC-1 | 0.016 |
| Yellow dye forming coupler Y-1 | 0.065 |
| Layer 5 | |
| Interlayer | |
| Gelatin | 0.43 |
| Oxidized developer scavenger O-2 () | 0.075 |
| Layer 6 | |
| Slow magenta layer | |
| Tabular emulsion, 0.8 × .11, 2.6 mole % I | 0.38 |
| Gelatin | 1.18 |

-continued

| | |
|---|---|
| Magenta dye forming coupler M-1 | 0.27 |
| Masking Coupler MC-2 | 0.043 |
| Layer 7 | |
| Mid magenta layer | |
| Tabular emulsion, 1.1 × .12, 4.1 mole % I | 0.70 |
| Gelatin | 1.16 |
| Development inhibitor releasing coupler DIR-3 | 0.016 |
| Magenta dye forming coupler M-1 | 0.12 |
| Masking Coupler MC-2 | 0.054 |
| Layer 8 | |
| Fast magenta layer | |
| Tabular emulsion, 1.4 × .12, 4.1 mole % I | 0.75 |
| Gelatin | 1.04 |
| Development inhibitor releasing coupler DIR-4 | 0.011 |
| Magenta dye forming coupler M-1 | 0.053 |
| Masking Coupler MC-2 | 0.043 |
| Layer 9 | |
| Yellow filter layer | |
| Yellow filter dye AD-1 | 0.13 |
| Gelatin | 0.65 |
| Oxidized developer scavenger O-2 () | 0.075 |
| Layer 10 | |
| Slow yellow layer | |
| Tabular emulsion, 1.4 × .13, 4.1 mole % I | 0.25 |
| Tabular emulsion, 1.1 × .13, 1.5 mole % I | 0.10 |
| Tabular emulsion, 0.5 × .08, 1.3 mole % I | 0.15 |
| Gelatin | 2.77 |
| Yellow dye forming coupler Y-1 | 0.70 |
| Yellow dye forming coupler Y-2 | 0.59 |
| Development inhibitor releasing coupler DIR-6 | 0.12 |
| Development inhibitor releasing coupler DIR-3 | 0.022 |
| Bleach accelerator releasing coupler B-1 | 0.005 |
| Layer 11 | |
| Fast yellow layer | |
| Tabular emulsion, 2.9 × .13, 4.1 mole % I | 0.56 |
| Gelatin | 1.50 |
| Yellow dye forming coupler Y-1 | 0.18 |
| Yellow dye forming coupler Y-2 | 0.15 |
| Development inhibitor releasing coupler DIR-6 | 0.057 |
| Development inhibitor releasing coupler DIR-3 | 0.006 |
| Bleach accelerator releasing coupler B-1 | 0.005 |
| Layer 12 | |
| UV filter layer | |
| Silver bromide Lippmann emulsion | 0.215 |
| UV-1 | 0.108 |
| UV-2 | 0.108 |
| Gelatin | 0.699 |
| Layer 13 | |
| Protective overcoat layer | |
| Colloidal silica | 0.108 |
| Gelatin | 0.882 |

Hardener(bis(vinylsulfonyl)methane at 1.50% of total gelatin weight). Unless otherwise noted, antifoggants (including 4-hydroxy-6-methyl-1,3,3a,7-tetraazaindene), surfactants, coating aids, emulsion addenda, sequestrants, lubricants, matte, tinting dyes, coupler solvents, and soluble absorber dyes were added to the appropriate layers as is common in the art. Magnetic recording layers were coated on the backside of the support.

Coating 2-2 was prepared like coating 2-1 except that in layer 1 UV-1 was omitted, UV-2 was omitted, and CS-2 was omitted.

Coating 2-3 was prepared like coating 2-1 except that in layer 1 UV-1 was omitted, UV-2 was omitted, CS-2 was omitted, O-2 was omitted, and CS-3 was omitted.

Coating 2-4 was prepared like coating 2-1 except that the support was cellulose triacetate, and the hardener was coated at 1.80% of total gelatin weight. The magnetic layers were omitted from the backside of the support.

Spark sensitivity test

A coated photographic film to be tested was exposed through a step tablet to a simulated static discharge (spark) by using a Xenon flash bulb. The Xenon flash with proper filtration, provides a very short exposure to the ultraviolet spectrum (from 300 nm to 400 nm approximately). Samples were then processed and the relative speed points were determined to evaluate the sensitivity of the samples to sparking relative to the acetate support check, 2-4. Exposure through the back provides an indication of how well the bottom-most non-imaging layers and the support are protecting the overlying imaging layers from fogging due to static discharge.

The results are shown in Table II.

TABLE II

| Coating # | Type | Layer 1 gel/CS | Appearance of Cut Edge | Red Minimum Density | Red LogH spark sensitivity |
|---|---|---|---|---|---|
| 2-1 | Comp | 2.5 | Delaminated | .21 | −1.16 |
| 2-2 | Inv | 2.9 | ok | .21 | −0.73 |
| 2-3 | Inv | 4.2 | ok | .27 | — |
| 2-4 | Check | 2.5 | Delaminated | .21 | 0 |

Gel/CS refers to (gelatin level)/(total coupler solvent level) and is a good indicator of the strength of a layer.

As indicated, the acetate coating of this set (2-4) has adequate spark protection, and can be used to benchmark the performance of the other coatings. Although the UV dyes appear to provide added protection, both coatings 2-1 and 2-2 demonstrate adequate spark protection since they have lower sensitivity to spark than the acetate coating 2-4. Coating 2-1 does not have enough gelatin to hold together the coupler solvent load. It has been found that gel/CS ratios greater or equal to 2.9 are necessary to insure adequate layer integrity. Coating 2-2 provides the best combination of features for finishability, minimum density, and thickness. Coating 2-3 would be useful for a film without stringent minimum density requirements.

Example 3

To a glow-discharge-treated polyethylene-2,6-naphthalene support, which was coated with a continuous subbing layer consisting of a terpolymer of n-butyl acryate, 2-aminoethyl methacrylate hydrochloride, and 2-hydroxyethyl methacrylate (50:05:45), gelatin, and surfactant; the following layers were applied in the indicated sequence to produce Coating 3-1. The quantities quoted each relate to g/m$^2$. Emulsion sizes as determined by the disc centrifuge method are reported in Diameter×Thickness in microns. The emulsions in the cyan layers are sensitized with dye set 1. The emulsions in the magenta layers are sensitized with dye set 2. The emulsions in the yellow 5 layers are sensitized with sensitizing dye YD-A.

| | | |
|---|---|---|
| Layer 1 | AntiHalation Undercoat | |
| | Black colloidal silver | 0.151 |
| | Gelatin | 1.61 |
| | Hexasodium salt of metaphosphoric acid | 0.011 |
| | Disodium salt of 3,5,-disulfocatecol | 0.270 |
| | 4-4-phenyl disulfide diacetanilide | 0.0012 |
| | 4-carboxymethyl-4-thiazolone-2-thione | 0.0009 |
| Layer 2 | Interlayer | |
| | Gelatin | 0.70 |
| Layer 3 | Slow cyan layer | |
| | Tabular emulsion, 1.1 × .09, 4.1 mole % I | 0.28 |
| | Tabular emulsion, 0.5 × .08, 1.3 mole % I | 0.48 |
| | Gelatin | 2.01 |
| | Cyan dye forming coupler C-1 | 0.48 |
| | Masking Coupler MC-1 | 0.028 |
| Layer 4 | Mid cyan layer | |
| | Tabular emulsion, 1.3 × .12, 4.1 mole % I | 0.79 |
| | Gelatin | 1.18 |
| | Cyan dye forming coupler C-1 | 0.15 |
| | Masking Coupler MC-1 | 0.022 |
| Layer 5 | Fast cyan layer | |
| | Tabular emulsion, 2.5 × .13, 4.1 mole % I | 1.076 |
| | Gelatin | 1.42 |
| | Cyan dye forming coupler C-1 | 0.054 |
| | Masking Coupler MC-1 | 0.032 |
| Layer 6 | Interlayer | |
| | Gelatin | 0.70 |
| | Oxidized developer scavenger O-2 () | 0.075 |
| Layer 7 | Slow magenta layer | |
| | Tabular emulsion, 0.8 × .12, 4.1 mole % I | 0.24 |
| | Tabular emulsion, 0.5 × .08, 1.3 mole % I | 0.51 |
| | Gelatin | 1.18 |
| | Magenta dye forming coupler M-1 | 0.30 |
| | Masking Coupler MC-2 | 0.042 |
| Layer 8 | Mid magenta layer | |
| | Tabular emulsion, 1.3 × .12, 4.1 mole % I | 0.97 |
| | Gelatin | 1.32 |
| | Development inhibitor releasing coupler DIR-3 (114CFP) | 0.024 |
| | Magenta dye forming coupler M-1 () | 0.057 |
| | Masking Coupler MC-2 () | 0.032 |
| Layer 9 | Fast magenta layer | |
| | Tabular emulsion, 2.3 × .12, 4.1 mole % I | 0.97 |
| | Gelatin | 1.55 |
| | Development inhibitor releasing coupler DIR-4 | 0.011 |
| | Development inhibitor releasing coupler DIR-5 | 0.011 |
| | Magenta dye forming coupler M-1 | 0.088 |
| | Masking Coupler MC-2 | 0.043 |
| Layer 10 | Yellow filter layer | |
| | Yellow filer dye AD-1 | 0.16 |
| | Gelatin | 0.65 |
| | Oxidized developer scavenger O-2 () | 0.075 |
| Layer 11 | Slow yellow layer | |
| | Tabular emulsion, 1.7 × .13, 4.1 mole % I | 0.23 |
| | Tabular emulsion, 1.1 × .13, 1.5 moie % I | 0.089 |
| | Tabular emuision, 0.5 × .08, 1.3 mole % I | 0.19 |
| | Gelatin | 1.72 |
| | Yellow dye forming coupler Y-3 | 0.69 |
| | Development inhibitor releasing coupler DIR-7 | 0.022 |
| | Bleach accelerator releasing coupler B-2 | 0.002 |
| Layer 12 | Fast yellow layer | |
| | Tabular emulsion, 3.3 × .14, 4.1 mole % I | 0.48 |
| | Gelatin | 1.38 |
| | Yellow dye forming coupler Y-3 | 0.53 |
| | Development inhibitor releasing coupler DIR-7 | 0.034 |
| | Bleach accelerator releasing coupler B-2 | 0.006 |
| | Cyan dye forming coupler C-1 | 0.022 |

-continued

| | | |
|---|---|---|
| Layer 13 | UV filter layer | |
| | Silver bromide Lippmann emulsion | 0.215 |
| | UV-1 | 0.108 |
| | UV-2 | 0.108 |
| | Gelatin | 0.699 |
| Layer 14 | Protective overcoat layer | |
| | Matte Beads | |
| | Gelatin | 0.882 |

Hardener(bis(vinylsulfonyl)methane at 1.80% of total gelatin weight). Unless otherwise noted, antifoggants (including 4-hydroxy-6-methyl-1,3,3a,7-tetraazaindene), surfactants, coating aids, emulsion addenda, sequestrants, lubricants, matte, coupler solvents, and tinting dyes were added to the appropriate layers as is common in the art. Magnetic recording layers were coated on the backside of the support.

Coating 3-2 was prepared like coating 3-1 except that to layer 1 was added oxidized developer scavenger O-2 at 0.14 g/m$^2$ which was dispersed in coupler solvent CS-4 at 0.21 g/m$^2$.

Coating 3-3 was prepared like coating 3-1 except that to layer 1 was added oxidized developer scavenger O-2 at 0.14 g/m$^2$ which was dispersed in coupler solvent CS-3 at 0.23 g/m$^2$.

Adhesive Peel Force Test

A coated photographic film to be tested was scribed with a sharp blade in a straight line approximately 2 cm in length. An adhesive tape (3M 4171 vinyl tape) was adhered over the scribed line, and the edges of the strip were cut off to a width of 1.9 cm. Peeling of the tape was initiated by hand and then the tape was peeled off at an angle of 180 degrees at a peel rate of 5.1 cm/min. The adhesive strength was determined by measuring the minimum force (in grams) needed to peel the emulsion layers off the support.

The results are shown in Table III.

TABLE III

| Coating # | Type | Layer 1 gel/CS | Layer 1 CS logP | Minimum Peel Force | Layer 1 + Layer 2 Gelatin Coverage |
|---|---|---|---|---|---|
| 3-1 | Inv | — | — | 1048 | 2.3 |
| 3-2 | Preferred embodiment | 7.5 | 9.49 | 1226 | 2.3 |
| 3-3 | Inv | 7.1 | 4.69 | 841 | 2.3 |

All parts have adequate spark protection.

Coating 3-1 contains no coupler solvent or oxidized developer scavenger in layer 1. Coating 3-2 features an oxidized developer scavenger dispersed in a high logp solvent. This combination of oxidized developer scavenger plus high logP solvent provides a boost in dry adhesion between layer 1 and the subbed support. Coating 3-3 features an oxidized developer scavenger dispersed in a lower log P solvent. The adhesion of this combination is not as good as coating 3-1 or 3-2, but may still be acceptable.

Example 4

To a glow-discharge-treated polyethylene-2,6-naphthalene support, which was coated with a continuous subbing layer consisting of a terpolymer of n-butyl acryate, 2-aminoethyl methacrylate hydrochloride, and 2-hydroxyethyl methacrylate (50:05:45), gelatin, and surfactant; the following layers were applied in the indicated sequence to produce Coating 4-1. The quantities quoted each relate to g/m$^2$. Emulsion sizes as determined by the disc centrifuge method are reported in Diameter×Thickness in microns. The emulsions in the cyan layers are sensitized with dye set 1. The emulsions in the magenta layers are sensitized with dye set 2. The emulsions in the yellow layers are sensitized with sensitizing dye YD-A.

| | | |
|---|---|---|
| Layer 1 | AntiHalation Undercoat | |
| | Black colloidal silver | 0.17 |
| | Gelatin | 2.42 |
| | Hexasodium salt of metaphosphoric acid | 0.011 |
| | Disodium salt of 3,5,-disulfocatecol | 0.270 |
| | 4-4-phenyl disulfide diacetanilide | 0.0012 |
| | Dye 1 | 0.022 |
| | Dye 4 | 0.022 |
| | Oxidized developer scavenger O-2 () | 0.16 |
| | Dye 5 | 0.022 |
| | UV-1 | 0.075 |
| | UV-2 | 0.075 |
| | 4-carboxymethyl-4-thiazolone-2-thione | 0.0009 |
| | Coupler Solvent CS-1 | 0.21 |
| | Coupler Solvent CS-3 | 0.086 |
| | Coupler Solvent CS-4 | 0.22 |
| Layer 2 | Interlayer | |
| | Gelatin | 0.70 |
| | Oxidized developer scavenger O-2 () | 0.075 |
| Layer 3 | Slow cyan layer | |
| | Tabular emulsion, 1.1 × .09, 4.1 mole % I | 0.27 |
| | Tabuiar emulsion, 0.5 × .08, 1.3 mole % I | 0.47 |
| | Gelatin | 2.01 |
| | Cyan dye forming coupler C-1 | 0.46 |
| | Bleach accelerator releasing coupler B-2 | 0.078 |
| | Masking Coupler MC-1 | 0.027 |
| Layer 4 | Mid cyan layer | |
| | Tabular emulsion, 1.3 × .12, 4.1 mole % I | 1.08 |
| | Gelatin | 1.18 |
| | Cyan dye forming coupler C-1 | 0.16 |
| | Development inhibitor releasing coupler DIR-1 | 0.011 |
| | Masking Coupler MC-1 | 0.022 |
| Layer 5 | Fast cyan layer | |
| | Tabular emulsion, 2.5 × 0.13, 4.1 mole % I | 1.076 |
| | Gelatin | 1.24 |
| | Cyan dye forming coupler C-1 | 0.12 |
| | Development inhibitor releasing coupler DIR-1 | 0.019 |
| | Development inhibitor releasing coupler DIR-2 | 0.048 |
| | Masking Coupler MC-1 | 0.032 |
| Layer 6 | Interlayer | |
| | Gelatin | 0.70 |
| | Oxidized developer scavenger O-2 () | 0.075 |
| Layer 7 | Slow magenta layer | |
| | Tabular emulsion, 1.0 × .09, 4.1 mole % I | 0.24 |
| | Tabular emulsion, 0.5 × .08, 1.3 mole % I | 0.49 |
| | Gelatin | 1.18 |
| | Magenta dye forming coupler M-1 | 0.29 |
| | Masking Coupler MC-2 | 0.041 |
| Layer 8 | Mid magenta layer | |
| | Tabular emulsion, 1.3 × .12, 4.1 mole % I | 0.97 |
| | Gelatin | 1.13 |
| | Development inhibitor releasing coupler DIR-3 | 0.024 |
| | Magenta dye forming coupler M-1 | 0.048 |
| | Masking Coupler MC-2 | 0.032 |
| Layer 9 | Fast magenta layer | |
| | Tabular emulsion, 2.3 × .12, 4.1 mole % I | 0.97 |
| | Gelatin | 1.45 |
| | Development inhibitor releasing coupler DIR-4 | 0.011 |
| | Development inhibitor releasing coupler DIR-5 | 0.011 |
| | Magenta dye forming coupler M-1 | 0.088 |
| | Masking Coupler MC-2 | 0.043 |

-continued

| | | |
|---|---|---|
| Layer 10 | Yellow filter layer | |
| | Yellow filter dye AD-1 | 0.16 |
| | Gelatin | 0.65 |
| | Oxidized developer scavenger O-2 () | 0.075 |
| Layer 11 | Slow yellow layer | |
| | Tabular emulsion, 1.7 × .13, 4.1 mole % I | 0.23 |
| | Tabular emulsion, 1.1 × .13, 1.5 mole % I | 0.056 |
| | Tabular emulsion, 0.5 × .08, 1.3 mole % I | 0.19 |
| | Gelatin | 1.72 |
| | Yellow dye forming coupler Y-3 | 0.69 |
| | Development inhibitor releasing coupler DIR-7 | 0.022 |
| | Bleach accelerator releasing coupler B-2 | 0.002 |
| Layer 12 | Fast yellow layer | |
| | Tabular emulsion, 3.3 × .14, 4.1 mole % I | 0.54 |
| | Gelatin | 1.28 |
| | Yellow dye forming coupler Y-3 | 0.53 |
| | Development inhibitor releasing coupler DIR-7 | 0.034 |
| | Bleach accelerator releasing coupler B-2 | 0.006 |
| | Cyan dye forming coupler C-1 | 0.022 |
| Layer 13 | UV filter layer | |
| | Silver bromide Lippmann emulsion | 0.215 |
| | UV-1 | 0.108 |
| | UV-2 | 0.108 |
| | Gelatin | 0.699 |
| Layer 14 | Protective overcoat layer | |
| | Matte Beads | |
| | Gelatin | 0.882 |

Hardener(bis(vinylsulfonyl)methane at 1.80% of total gelatin weight). Unless otherwise noted, antifoggants (including 4-hydroxy-6-methyl-1,3,3a,7-tetraazaindene), surfactants, coating aids, emulsion addenda, sequestrants, lubricants, matte, coupler solvents, and tinting dyes were added to the appropriate layers as is common in the art. Magnetic recording layers were coated on the backside of the support.

Coating 4-2 was prepared like coating 4-1 except that layer 1 had a gelatin coverage of 1.61 g/m$^2$, UV-1 was omitted, UV-2 was omitted, and CS-1 was reduced to 0.10 g/m$^2$.

Coating 4-3 was prepared like coating 4-2 except that layer 2 was omitted.

Coating 4-4 was prepared like coating 4-3 except that in layer 1 O-2 was replaced with O-1 at equal weight coverage, CS-4 was omitted, and CS-1 was increased to 0.35.

Coating 4-5 was prepared like coating 4-3 except that in layer 1 O-2 and CS-4 were omitted.

Coating 4-6 was prepared like coating 4-3 except that in layer 1 O -2 and CS-4 were omitted, and the gelatin coverage was changed to 2.42 g/m$^2$.

Coating 4-7 was prepared like coating 4-3 except that layer 1 had a gelatin coverage of 1.4 g/m$^2$.

Coating 4-8 was prepared like coating 4-3 except for the following changes:

| | |
|---|---|
| Layer 1 | |
| Dye 4 | 0.006 |
| CS-1 | 0.12 |
| CS-3 | 0.026 |
| CS-4 | 0.25 |
| Dye 1 dispersed in CS-4 instead of CS-1 | |
| Layer 7 | |
| Tabular emulsion, 1.0 × .09 | 0.25 |
| Tabular emulsion, 0.5 × .08 | 0.51 |

-continued

| | |
|---|---|
| M-1 | 0.30 |
| MC-2 | 0.042 |
| Layer 8 | |
| M-1 | 0.043 |
| Gelatin | 0.32 |
| Layer 9 | |
| M-1 | 0.079 |
| Gelatin | 0.60 |
| Layer 12 | |
| Gelatin | 1.39 |
| Y-3 | 0.54 |
| DIR-7 | 0.035 |

The results are shown in Table IV.

TABLE IV

| Coating # | Type | Layer 1 gel/CS | Minimum Peel Force | Minimum Red Fog | Layer 1 + Layer 2 Gelatin Coverage |
|---|---|---|---|---|---|
| 4-1 | Comp | 4.7 | Did not peel | .11 | 3.1 |
| 4-2 | Preferred embodiment | 4.0 | Did not peel | .11 | 2.3 |
| 4-3 | Preferred embodiment | 4.0 | Did not peel | .15 | 1.6 |
| 4-4 | Preferred embodiment | 3.7 | Did not peel | .16 | 1.6 |
| 4-5 | Inv | 8.7 | Slight peel | .19 | 1.6 |
| 4-6 | Comp | 13.0 | 719 | .17 | 2.4 |
| 4-7 | Preferred embodiment | 3.5 | Did not peel | .17 | 1.4 |
| 4-8 | Preferred embodiment | 4.1 | Did not peel | .16 | 1.6 |

In order to determine the value for Minimum Red Fog, a coated photographic film to be tested was processed through two sequences. The first sequence was the standard C-41 process. The second sequence 10 processes the film first through C-41 Bleach, wash, C-41 Fix, wash, and then through the standard C-41 process. The difference in minimum density between these two sequences is a good measure of the amount of fog due to developed silver in a film. Minimum red fog refers to the minimum fog measured by a red Status M filter.

Coating 4-1 features a very thick non-imaging layer structure. Coatings 4-2, 4-3, 4-4, 4-7, and 4-8 provide the best combination of features for finishability, minimum density, and thickness. Coating 4-2 is advantaged for red dmin relative to coating 4-3, but contains 0.8 g/m$^2$ more gelatin. Coating 4-4 is like coating 4-3 except for the use of oxidized developer scavenger O-1 in place of O-2. Coating 4-5 would be useful for a film without stringent minimum density requirements, as it does not feature any oxidized developer scavenger. Coating 4-6 features an undesirably thick non-imaging antihalation layer, and also suffers from relatively poor dry adhesion. Coatings 4-7 and 4-8 illustrate various levels of materials within the scope of the invention.

Example 5

To a glow-discharge-treated polyethylene-2,6-naphthalene support, which was coated with a continuous subbing layer consisting of a terpolymer of n-butyl acryate, 2-aminoethyl methacrylate hydrochloride, and 2-hydroxyethyl methacrylate (50:05:45), gelatin, and surfactant; the following layers were applied in the indicated sequence to produce Coating 5-1. The quantities quoted each relate to g/m$^2$. Emulsion sizes as determined by the disc centrifuge method are reported in Diameter×Thickness in microns. The emulsions in the cyan layers are sensitized with dye set 1. The emulsions in the magenta layers are sensitized with dye set 2. The emulsions in the yellow layers are sensitized with sensitizing dye YD-A.

| | | |
|---|---|---|
| Layer 1 | AntiHalation Undercoat | |
| | Black colloidal silver | 0.15 |
| | Gelatin | 1.61 |
| | Hexasodium salt of metaphosphoric acid | 0.011 |
| | Disodium salt of 3,5,-disulfocatecol | 0.270 |
| | Dye 1 | 0.036 |
| | Dye 4 | 0.048 |
| | C-x | 0.056 |
| | Oxidized developer scavenger O-2 () | 0.108 |
| | Dye 5 | 0.027 |
| | 4-carboxymethyl-4-thiazolone-2-thione | 0.0014 |
| | Coupler Solvent CS-1 | 0.027 |
| | Coupler Solvent CS-3 | 0.10 |
| | Coupler Solvent CS-4 ) | 0.15 |
| Layer 6 | Interlayer | |
| | Gelatin | 0.54 |
| | Oxidized developer scavenger O-2 () | 0.075 |
| Layer 3 | Slow cyan layer | |
| | Tabular emulsion, 0.8 × .12, 4.1 mole % I | 0.27 |
| | Tabular emulsion, 0.5 × .08, 1.3 mole % I | 0.37 |
| | Gelatin | 1.57 |
| | Cyan dye forming coupler C-1 | 0.30 |
| | Bleach accelerator releasing coupler B-1 | 0.093 |
| Layer 4 | Mid cyan layer | |
| | Tabular emulsion, 1.1 × .12, 4.1 mole % I | 0.82 |
| | Gelatin | 1.35 |
| | Cyan dye forming coupler C-1 | 0.32 |
| | Development inhibitor releasing coupler DIR-1 | 0.043 |
| | Bleach accelerator releasing coupler B-1 | 0.005 |
| | Masking Coupler MC-1 | 0.011 |
| Layer 5 | Fast cyan layer | |
| | Tabular emulsion, 1.4 × .12, 4.1 mole % I | 0.86 |
| | Gelatin | 1.24 |
| | Cyan dye forming coupler C-1 | 0.086 |
| | Development inhibitor releasing coupler DIR-1 | 0.032 |
| | Masking Coupler MC-1 | 0.032 |
| Layer 6 | Interlayer | |
| | Gelatin | 0.54 |
| | Oxidized developer scavenger O-2 () | 0.075 |
| Layer 7 | Slow magenta layer | |
| | Tabular emulsion, 0.8 × .11, 2.6 mole % I | 0.53 |
| | Tabular emulsion, 0.5 × .08, 1.3 mole % I | 0.065 |
| | Gelatin | 1.18 |
| | Magenta dye forming coupler M-1 | 0.17 |
| | Masking Coupler MC-2 | 0.043 |
| Layer 8 | Mid magenta layer | |
| | Tabular emulsion, 1.1 × .12, 4.1 mole % I | 0.57 |
| | Gelatin | 1.35 |
| | Development inhibitor releasing coupler DIR-3 | 0.016 |
| | Magenta dye forming coupler M-1 | 0.16 |
| | Masking Coupler MC-2 | 0.043 |
| Layer 9 | Fast magenta layer | |
| | Tabular emulsion, 1.4 × .12, 4.1 mole % I | 0.97 |
| | Gelatin | 1.29 |
| | Development inhibitor releasing coupler DIR-4 | 0.013 |
| | Magenta dye forming coupler M-1 | 0.080 |
| | Masking Coupler MC-2 ( | 0.005 |
| Layer 10 | Yellow filter layer | |
| | Yellow filter dye AD-1 | 0.16 |
| | Gelatin | 0.65 |
| | Oxidized developer scavenger O-2 () | 0.075 |

-continued

| | | |
|---|---|---|
| Layer 11 | Slow yellow layer | |
| | Tabular emulsion, 1.4 × .13, 4.1 mole % I | 0.17 |
| | Tabular emulsion, 1.1 × .13, 1.5 mole % I | 0.19 |
| | Tabular emulsion, 0.5 × .08, 1.3 mole % I | 0.23 |
| | Gelatin | 1.42 |
| | Yellow dye forming coupler Y-3 | 0.70 |
| | Development inhibitor releasing coupler DIR-6 | 0.11 |
| | Development inhibitor releasing coupler DIR-3 | 0.022 |
| | Bleach accelerator releasing coupler B-1 | 0.005 |
| Layer 12 | Fast yellow layer | |
| | Tabular emulsion, 2.9 × .13, 4.1 mole % I | 0.53 |
| | Gelatin | 1.08 |
| | Yellow dye forming coupler Y-3 | 0.20 |
| | Development inhibitor releasing coupler DIR-6 | 0.058 |
| | Development inhibitor releasing coupler DIR-3 | 0.006 |
| | Bleach accelerator releasing coupler B-1 | 0.002 |
| Layer 13 | UV filter layer | |
| | Silver bromide Lippmann emulsion | 0.215 |
| | UV-1 | 0.108 |

-continued

| | | |
|---|---|---|
| | UV-2 | 0.108 |
| | Gelatin | 0.70 |
| Layer 14 | Protective overcoat layer | |
| | Matte Beads | |
| | Gelatin | 0.89 |

Hardener(bis(vinylsulfonyl)methane at 1.80% of total gelatin weight). Unless otherwise noted, antifoggants (including 4-hydroxy-6-methyl-1,3,3a,7-tetraazaindene), surfactants, coating aids, emulsion addenda, sequestrants, lubricants, matte, coupler solvents, and tinting dyes were added to the appropriate layers as is common in the art. Magnetic recording layers were coated on the backside of the support. The multilayer film meets the objectives of the invention.

Formulas for multilayer compounds:

AD-1:

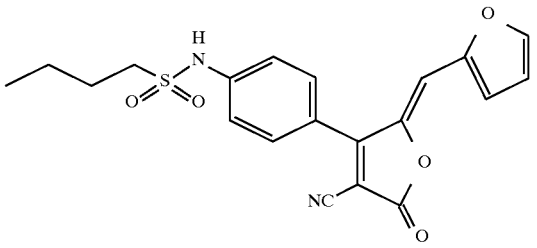

B-1

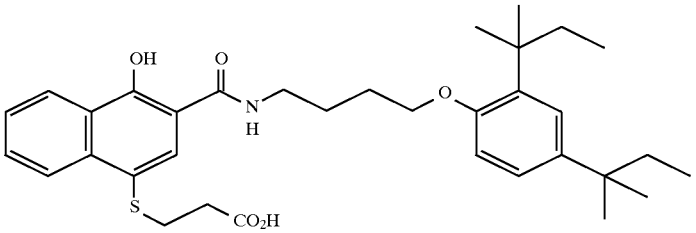

B-2

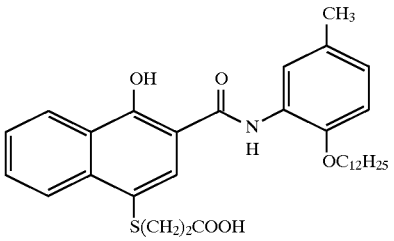

-continued
Formulas for multilayer compounds:
C-1
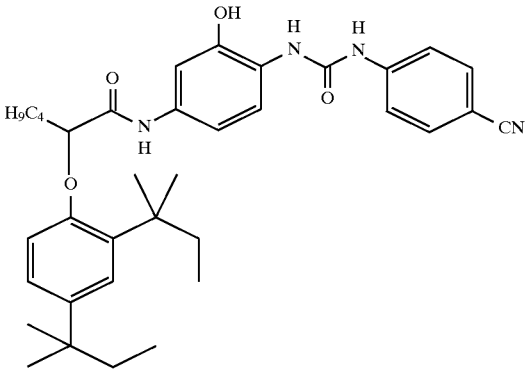
CS-1
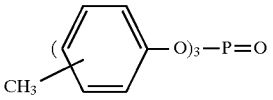
CS-2
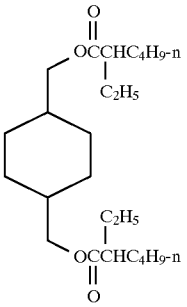
CS-3
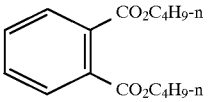
CS-4
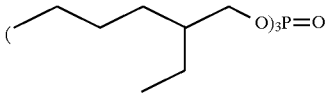
DIR-1
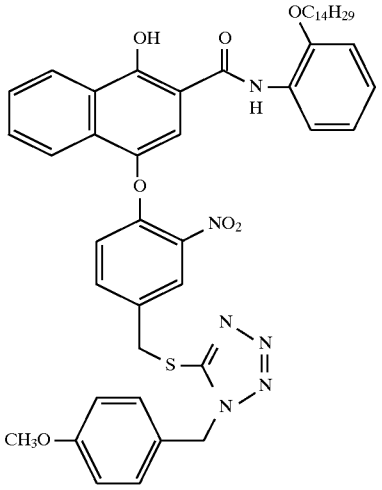

-continued
Formulas for multilayer compounds:
DIR-2
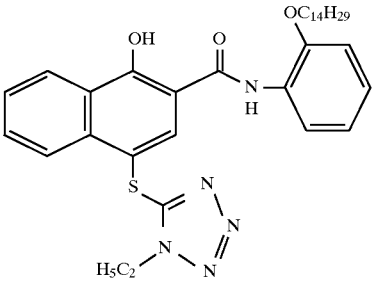
DIR-3
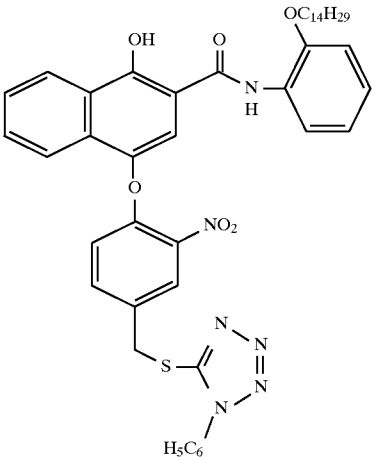
DIR-4
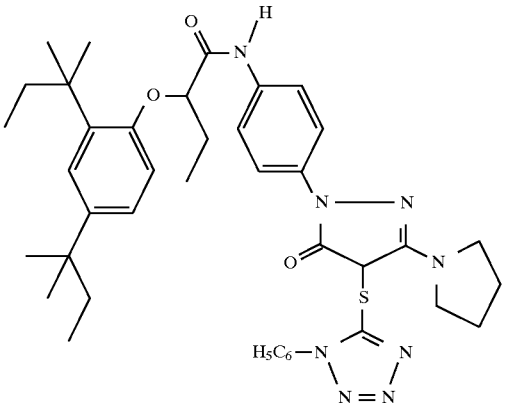
DIR-5
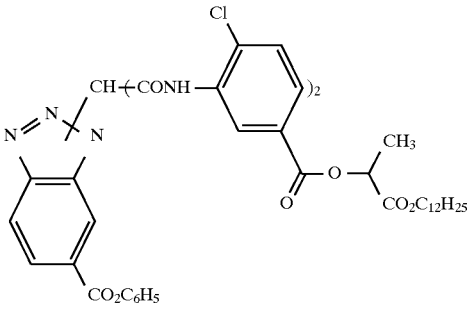

-continued
Formulas for multilayer compounds:
DIR-6
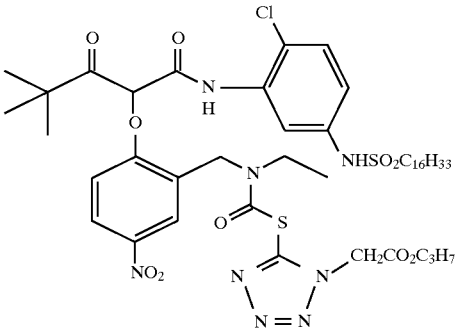
DIR-7
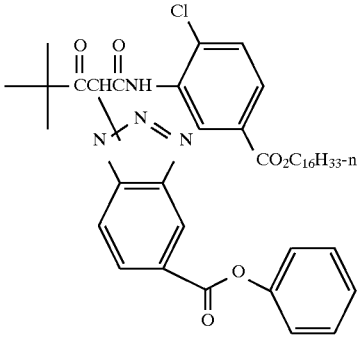
DYE-1
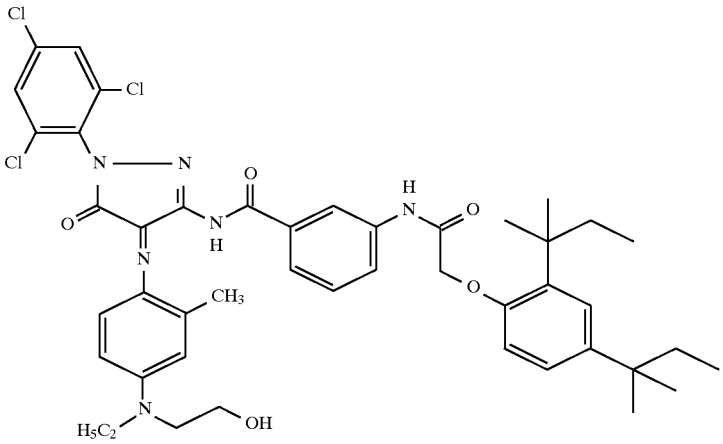
DYE-2
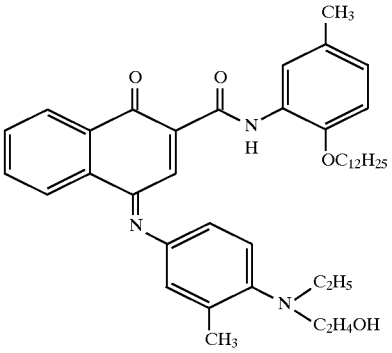

-continued
Formulas for multilayer compounds:
DYE-3
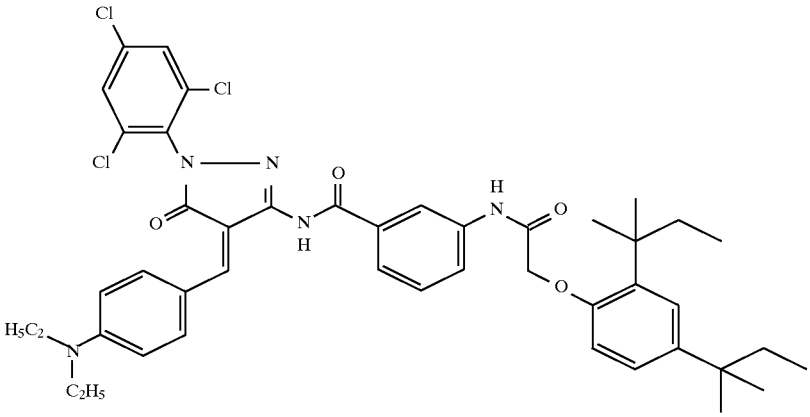
DYE-4
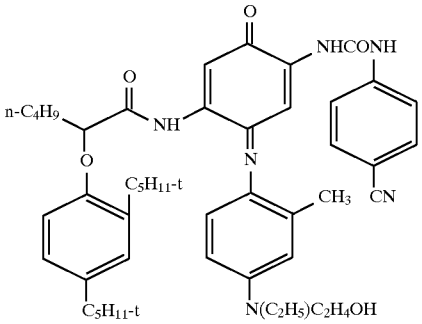
DYE-5
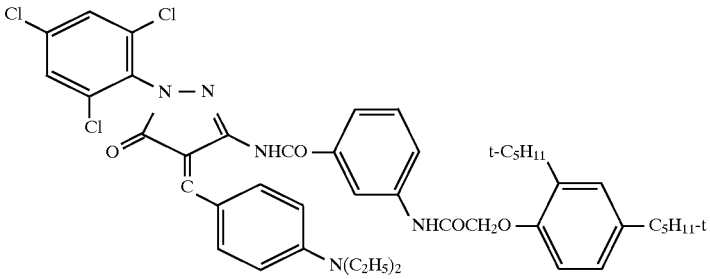
DYE-6
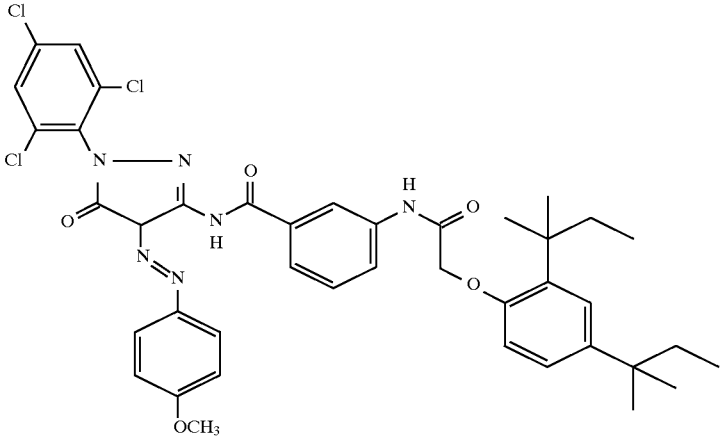

-continued
Formulas for multilayer compounds:
M-1
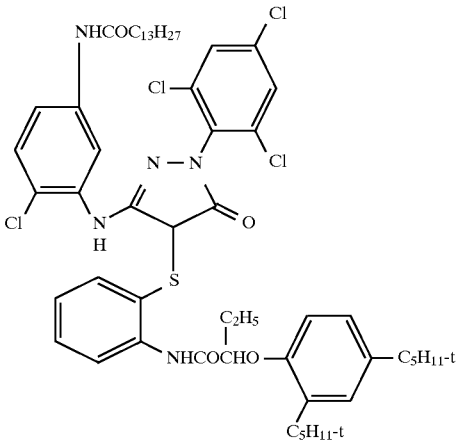
MC-1
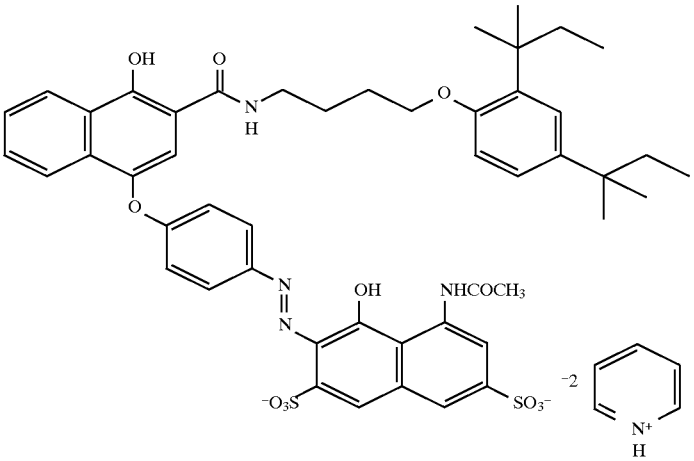
MC-2
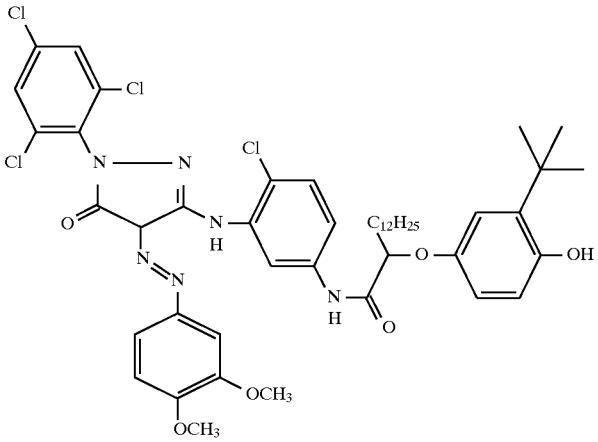

-continued
Formulas for multilayer compounds:
O-1
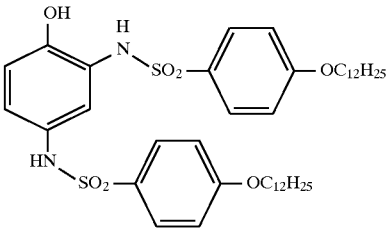
O-2
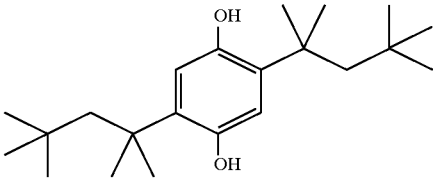
UV-1
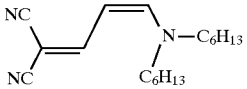
UV-2
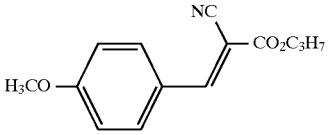
Y-1
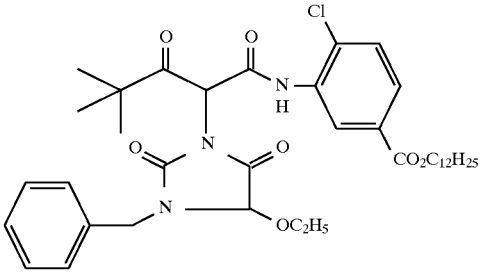
Y-2
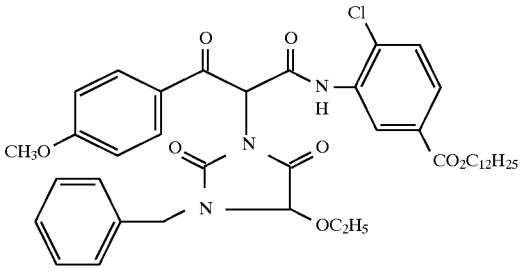
Y-3
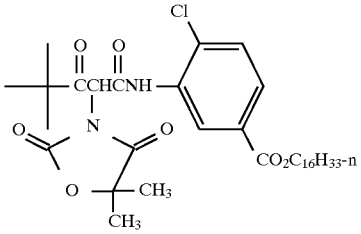

-continued

Formulas for multilayer compounds:

YD-A

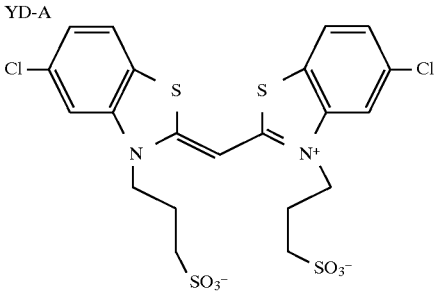

Dye Set 1: CD-A:CD-B at 9:1
Dye Set 2: MD-A:MD-B at 6:1

CD-A:

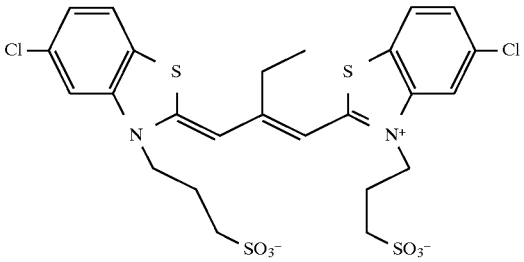

CD-B:

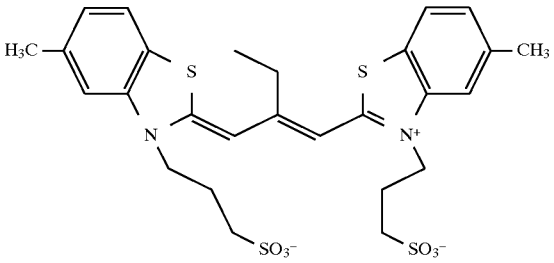

What is claimed is:

1. A multicolor photographic element comprising an ultraviolet ray absorbing polyester support comprising a polymer derived from a fused polycyclic aromatic dicarboxylate monomer which may be a homopolymer, a copolymer or a graft polymer, bearing a light-sensitive silver halide photographic emulsion layer, the support having adjacent thereto one or more contiguous non imaging layers between the support and the closest silver halide photographic emulsion layer, said one or more contiguous layers containing a combined gelatin laydown of 2.3g/m$^2$ or less, containing an antihalation agent, the contiguous nonimaging layers being substantially free of ultraviolet absorbing compounds and having a gel to solvent weight ratio of at least 2.9.

2. A photographic element as in claim 1 wherein said one or more contiguous layers contain a combined gelatin laydown of 2.0g/m$^2$ or less.

3. A photographic element as in claim 2 wherein said one or more contiguous layers contain a combined gelatin laydown of 1.7g/m$^2$ or less.

4. A photographic element as in claim 1 wherein said one or more contiguous layers contain a scavenger for oxidized developing agent.

5. A photographic element as in claim 4 wherein the scavenger for oxidized developing agent is selected from the group consisting of:

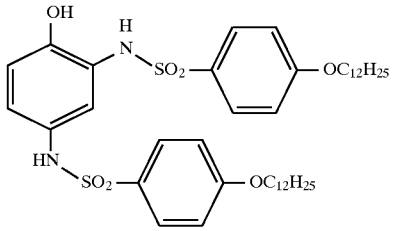

and

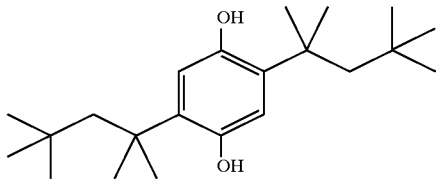

.

6. A photographic element as in claim 5 wherein the scavenger is dispersed in a high boiling solvent.

7. The photographic element of claim 6 wherein the log P of the solvent for the scavenger is at least 7.7.

8. A photographic element as in claim 1 wherein the polyester support comprises at least one polymer derived from a monomer selected from the group consisting of 2,5-, 2-6-, and 2,7-naphthalene dicarboxylic acids.

9. A photographic element as in claim 8, wherein said polyester support is polyethylene-2,6-naphthalate.

10. A photographic element as in claim 4, wherein said polyester support comprises a polyethylene naphthalate.

11. The photographic element of claim 7 wherein the support comprises a polyethylene naphthalate.

12. The photographic element of claim 7 wherein the solvent is tri-2-ethylhexyl phosphate.

13. The photographic element of claim 1 wherein the combined contiguous layers contain less than 0.1 $g/m^2$ of ultraviolet absorbing compounds.

14. A photographic element as in claim 1 wherein the support contains also a subbing layer, the subbing layer including a polymer containing one of the monomers selected from the group consisting of acrylic acid, sodium acrylate, methacrylic acid, itaconic acid, crotonic acid, sorbic acid, itaconic anhydride, maleic anhydride, cinnamic acid, methyl vinyl ketone, hydroxyethyl acrylate, hydroxyethyl methacrylate, hydroxychloropropyl methacrylate, hydroxybutyl acrylate, vinylsulfonic acid, potassium vinylbenezensulfonate, acrylamide, N-methylamide, N-methylacrylamide, acryloylmorpholine, dimethylmethacrylamide, N-t-butylacrylamide, diacetonacrylamide, vinylpyrrolidone, glycidyl acrylate, glycidyl methacrylate, and copolymers of the above monomers with other copolymerizable monomers.

15. A photographic element as in claim 14 wherein the subbing layer includes at least one polymer containing a monomer selected from the group consisting of vinylidene chloride, acrylonitrile, acrylate, and methacrylate.

16. A photographic element as in claim 15 wherein said polymer is selected from the group consisting of butyl acrylate, 2-aminoethyl methacrylate hydrochloride, and hydroxyethyl methacrylate.

17. A photographic element as in claim 1 wherein said antihalation component is elemental silver.

* * * * *